United States Patent [19]

Kamimura

[11] Patent Number: 5,050,484

[45] Date of Patent: Sep. 24, 1991

[54] HYDRAULIC ACTUATOR WITH LOCKING MECHANISM

[75] Inventor: Toshio Kamimura, Iwate, Japan

[73] Assignee: Teijin Seiki Company Limited, Osaka, Japan

[21] Appl. No.: 514,288

[22] Filed: Apr. 25, 1990

[30] Foreign Application Priority Data

May 1, 1989 [JP] Japan ..... 1-112659

[51] Int. Cl.[5] ..... F01B 25/26

[52] U.S. Cl. ..... 92/5 L; 92/18; 92/24; 92/27; 91/41; 91/44

[58] Field of Search ..... 92/5 L, 15, 23, 24, 92/26, 27, 28, 18; 91/41, 44, 45

[56] References Cited

U.S. PATENT DOCUMENTS

| | | | |
|---|---|---|---|
| 2,295,961 | 9/1942 | Meyer | 92/5 L |
| 2,323,731 | 7/1943 | Shetzline | 92/28 |
| 2,582,030 | 1/1952 | Halward | 92/27 |
| 3,108,513 | 10/1963 | Koshobu | 92/27 |
| 3,605,568 | 7/1971 | Nepp | 92/5 L |
| 4,167,891 | 9/1979 | Kamimura | 92/27 |
| 4,240,332 | 12/1980 | Deutsch | 92/5 L |
| 4,295,413 | 10/1981 | Kamimura | 92/5 L |
| 4,518,309 | 5/1985 | Brown | 92/27 |

FOREIGN PATENT DOCUMENTS

| | | | |
|---|---|---|---|
| 0021377 | 2/1978 | Japan | 92/23 |
| 0014609 | 2/1981 | Japan | 92/27 |
| 421807 | 8/1974 | U.S.S.R. | 92/23 |
| 2073820 | 10/1981 | United Kingdom | 92/27 |

*Primary Examiner*—Edward K. Look
*Assistant Examiner*—Thomas Denion
*Attorney, Agent, or Firm*—Lane, Aitken & McCann

[57] ABSTRACT

A hydraulic actuator comprising a cylinder formed with an axial cylinder chamber, a main piston provided in the cylinder chamber and dividing the chamber into a first chamber and a second chamber and further formed with a locking chamber, an annular locking groove formed in the cylinder, a locking member cooperating with the annular locking groove to lock the main piston in a predetermined position, the locking member movable between an unlocking position and a locking position, a locking-unlocking piston for moving the locking member into the locking and unlocking positions, and a pressure introducing passageway for selecting the first or second chamber that is higher in pressure and introducing the higher pressure in the selected chamber into the locking chamber of the main piston. The locking-unlocking piston is moved by the pressure introduced by the pressure introducing passageway to move the locking member into the locking and unlocking positions.

11 Claims, 2 Drawing Sheets

HYDRAULIC ACTUATOR WITH LOCKING MECHANISM

FIELD OF THE INVENTION

The present invention relates generally to a hydraulic actuator with a locking mechanism wherein an operating piston is locked in a central position or predetermined position, and more particularly to such an actuator that is well suited to aircraft and the like.

DESCRIPTION OF THE PRIOR ART

Hydraulic actuators with locking mechanisms are well prior art. For example, such a hydraulic actuator has been described in U.S. Pat. No. 3,605,568. The actuator has a first main port pressurized to retract its main piston and a second main port pressurized to extend the main piston. The actuator is further provided with a locking port pressurized to effect locking and an unlocking port pressurized to effect unlocking. The main piston is formed at its interior surface with an annular locking groove. A plurality of locking members are provided and movable radially between a locking position wherein the members are engaged with the annular locking groove of the main piston to lock the main piston and an unlocking position wherein the members are disengaged from the annular locking groove to unlock the main piston. When it is desired to unlock the main piston, unlocking pressure is supplied through the unlocking port, so that the locking elements are moved radially inwardly to the unlocking position. When it is desired to lock the main piston, locking pressure is supplied through the locking port, so that the locking elements are moved radially outwardly to the locking position.

However, the hydraulic actuator of the above type has been complicated and expensive, since it requires additional unlocking and locking ports through which fluid under pressure are supplied from the outside of the actuator. Also, the structure for the unlocking and locking ports has been bulky and could not make the hydraulic actuator compact.

It is therefore an object of the present invention to provide an improved hydraulic actuator with a locking mechanism which is structurally simpler, less expensive, and more compact than the conventional hydraulic actuator.

SUMMARY OF THE INVENTION

In order to achieve the above object, there is provided a hydraulic actuator comprising:

a cylinder formed with an axial cylinder chamber, a first port, and a second port;

a main piston provided in the cylinder chamber and dividing the chamber into a first chamber communicating with the first port and a second chamber communicating with the second port;

the main piston being formed with a locking chamber;

an annular locking groove formed in the cylinder;

a locking member cooperating with the annular locking groove to lock the main piston in a predetermined position;

the locking member being supported to the main piston so as to move radially inwardly into an unlocking position to unlock the main piston and radially outwardly into a locking position to lock the main piston;

a locking-unlocking piston for moving the locking member into the locking and unlocking positions;

the locking-unlocking piston being provided in the locking chamber of the main piston;

pressure introducing means for selecting the first or second chamber that is higher in pressure and introducing the higher pressure in the selected chamber into the locking chamber of the main piston;

the pressure introducing means being formed in the main cylinder; and the locking-unlocking piston being moved by the pressure introduced by the pressure introducing means to move the locking member into the locking and unlocking positions.

The pressure introducing means may comprise a passageway formed in the main piston and having ends opening to the first and second chambers and an end opening to the working chamber of the main piston, and an orifice and a check valve which are provided in the passageway.

The hydraulic actuator may further comprise an orifice formed in the locking-unlocking piston;

a hollow cylindrical member mounted in the cylinder and having the main piston slidably inserted thereon;

a passageway formed in the hollow cylindrical member; and the higher pressure introduced into the working chamber by the pressure introducing means being drained through the orifice formed in the locking-unlocking piston and through the passageway formed in the hollow cylindrical member.

In addition, the hydraulic actuator may further comprise displacement detecting means having coils mounted on the hollow cylindrical member and an iron core fixed to the main piston and inserted into the passageway of the hollow cylindrical member, for detecting a displacement of the main piston relative to the cylinder from the relative displacement between the core and the hollow cylindrical member.

In addition, the hydraulic actuator may further comprise displacement detecting means having coils mounted on the hollow cylindrical member and an iron core fixed to the main piston and inserted into the passageway of the hollow cylindrical member, for detecting a displacement of the main piston relative to the cylinder from the relative displacement between the core and the hollow cylindrical member.

In addition, the hydraulic actuator may further comprise spring-biased detent means for holding the locking member in its unlocking position.

In the present invention, the higher pressure in the first or second chamber in the cylinder is introduced by the pressure introducing means into the working chamber of the main piston, and the locking-unlocking piston is moved by the higher pressure. This movement causes the locking member to move into its locking position. Therefore, since the pressure in the first or second chamber used for operating the main piston is also used for unlocking and locking the main piston and since the unlocking and locking parts inevitably employed in the conventional hydraulic actuator are not needed, the present invention is structurally simple, inexpensive and compact.

In addition, if the fluid that has been used for operating the locking mechanism is circulated through the orifice formed in the locking-unlocking piston and the passageway formed in the hollow cylindrical member, a control of heat such as cooling can be effectively performed even when the range of operating temperatures of the actuator with the locking mechanism is wider.

Further, if coils are mounted on the hollow cylindrical member and an iron core is fixed to the main cylinder and inserted into the passageway of the hollow cylindrical member, there will be provided a hydraulic actuator with a locking mechanism which is well suitable to a servo actuator which can detect accurately the position of the main piston.

BRIEF DESCRIPTION OF THE DRAWINGS

The above and other objects and advantages will become apparent from the following detailed description when read in conjunction with the accompanying drawings wherein.

DESCRIPTION OF THE PREFERRED EMBODIMENT

Figure 1:
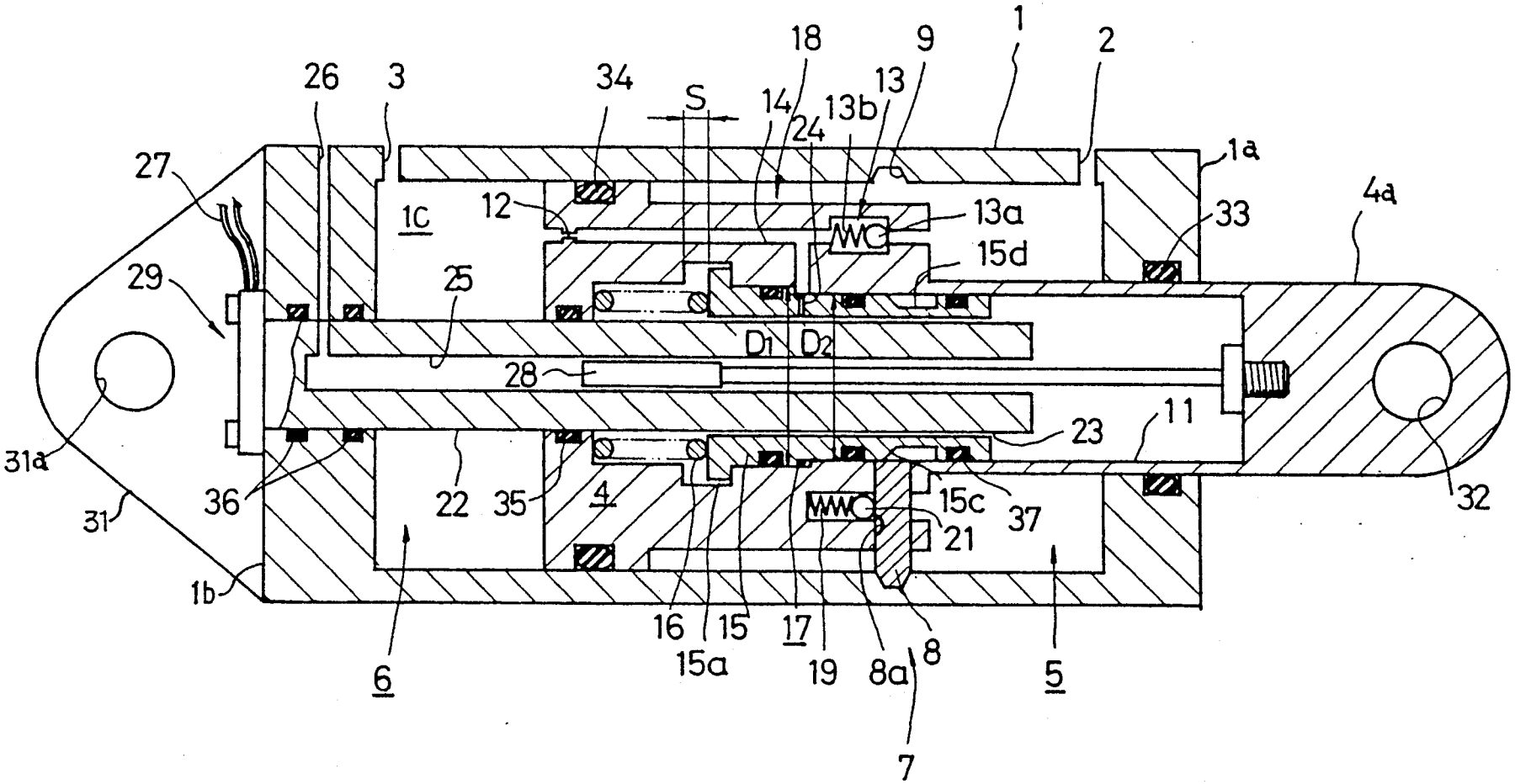
FIG. 1 is a longitudinal cross-sectional view showing a hydraulic actuator with a locking mechanism according to the present invention in its locked position.
Figure 2:
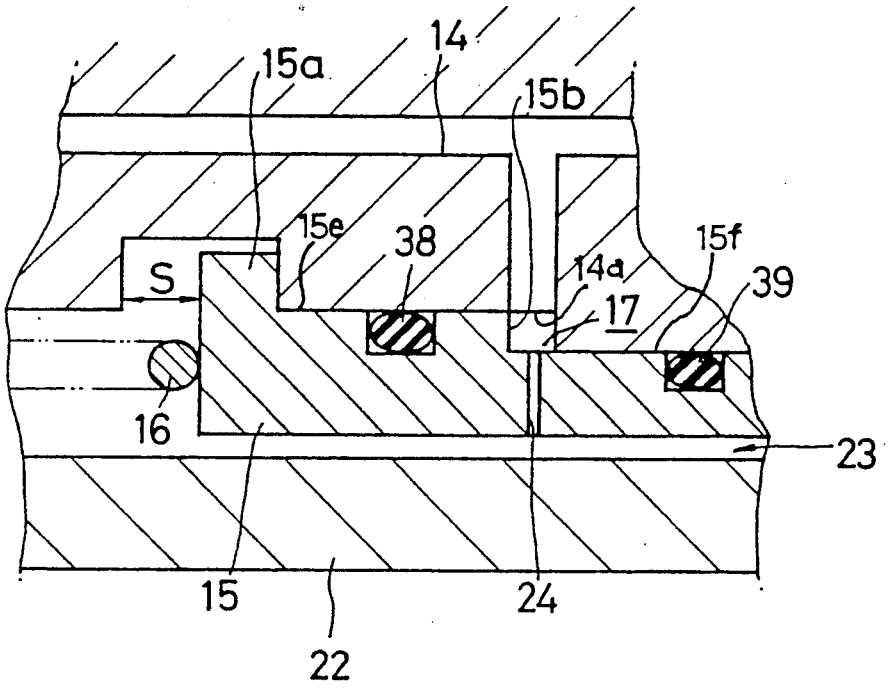
FIG. 2 is an enlarged cross-sectional view, partly broken away, showing the locking piston portion of FIG. 1 in its locked position.

Referring to FIGS. 1 and 2, there is shown a preferred embodiment of a hydraulic actuator with a locking mechanism in accordance with the present invention. The hydraulic actuator comprises a cylinder 1 which has an integral forward end cap 1*a* and an integral back end cap 1*b*. The cylinder 1 is formed at its opposite ends with a first or retracting port 2 pressurized to retract a main piston 4 and a second or extending port 3 pressurized to extend the main piston 4. The cylinder 1 is further formed with a cylinder chamber 1*c* which is closed by the end caps 1*a* and 1*c*. The main piston 4 is axially slidably movable within the cylinder chamber 1 and sealed to the interior surface of the cylinder 1 by a sealing ring 34. The main piston 4 divides the cylinder chamber 1*c* into a first cylinder chamber 5 communicating with the retracting port 2 and a second cylinder chamber 6 communicating with the extending port 3. The main piston 4 has a piston rod 4*a* axially extending therefrom and through the bore formed in the forward end cap 1*a*, and the piston rod 4*a* is sealed to the forward end cap 1*a* by a sealing ring 33. The piston rod 4*a* is formed with an eye 32 used for connection. Also, the back end cap 1*b* has secured thereto a bracket 31 having an eye 31*a* used for connection.

Within the main piston 4 is provided a locking mechanism 7 comprising a locking member 8. The locking member 8 is movable radially between a locking position wherein the member 8 is engaged with an annular locking groove 9 formed in the cylinder 1 to lock the main piston 4 and an unlocking position wherein the member 8 is disengaged from the annular locking groove 9 to unlock the main piston 4.

The locking mechanism 7 further comprises an axially extending locking chamber 11 formed in both the main piston 4 and the piston rod 4*a*, and a pressure introducing passageway 14 communicating with the locking chamber 11. As shown in FIG. 1, the pressure introducing passageway 14 is formed in the main piston 4 so that fluid pressure in the second cylinder chamber 6 can be introduced through an axial orifice 12 into the locking chamber 11 and that fluid pressure in the first cylinder chamber 5 can be introduced through a check valve 13 into the locking chamber 11. The locking mechanism 7 further comprises a locking-unlocking piston 15 slidably received in the locking chamber 11 of the main piston 4 and having a radial flange portion 15*a* movable by a predetermined distance S, and a spring 16 disposed between the main piston 4 and the locking-unlocking piston 15 to bias the piston 15 into its locking position, as shown in FIG. 1. The locking-unlocking piston 15 is sealed to the main piston 4 and piston rod 4*a* by sealing rings 37.

The locking chamber 11 has an enlarged portion of D1 in diameter and a reduced portion of D2 in diameter, and the open end 14*a* of the pressure introducing passageway 14 is disposed between the enlarged and reduced portions, as shown in FIG. 2. The locking-unlocking piston 15 further has an enlarged axial portion 15*e* extending from the radial flange portion 15*a* and a reduced axial portion 15*f* extending from the enlarged portion 15*e*. The enlarged and reduced axial portions 15*e* and 15*f* of the locking-unlocking piston 15 are slidably received on the enlarged and reduced portions of the locking chamber 11, respectively. The locking-unlocking piston 15 further has a working surface 15*b* which is disposed between the enlarged and reduced axial portions 15*e* and 15*f* and on which the fluid pressure from the first cylinder chamber 5 or second cylinder chamber 6 works to move the locking-unlocking piston 15 into its unlocked position. Within the locking chamber 11 adjacent to the working surface 15*b* of the locking-unlocking piston 15, a working chamber 17 is defined by the main piston 4 and the locking-unlocking piston 15, and communicates with the open end 14*a* of the pressure introducing passageway 14.

The check valve 13 disposed in the pressure introducing passageway 14 adjacent to the first cylinder chamber 5 comprises a ball 13*a* and a spring 13*b*, and if the differential pressure between the upstream side (first cylinder chamber 5) and downstream side of the ball 13*a* reaches a predetermined pressure, then the ball 13*a* is moved toward the downstream side against the spring 13*b*. Consequently, the first cylinder chamber 5 is communicated with the working chamber 17. Therefore, when the check valve 13 has been closed, the fluid pressure in the second cylinder chamber 6 is introduced through the axial orifice 12 into the working chamber 17. When, on the other hand, the check valve 13 has been opened, the fluid pressure in the first cylinder chamber 5 is introduced through the valve 13 into the working chamber 17. At this time, although the working fluid introduced in the chamber 5 also flows into the opposite chamber 6 through the orifice 12, the working fluid to be introduced in the chamber 6 is a small amount due to the orifice 12 and discharged through port 3. Therefore, the introduction of fluid into the chamber 6 via the orifice 12 does not influence pressure rise in the working chamber 17. By the pressure rise in the working chamber 17, the locking-unlocking piston 15 is moved toward the left of FIG. 1 against the bias of the spring 16 by the predetermined distance S from the position of FIG. 1. The axial orifice 12, check valve 13 and pressure introducing passageway 14 as a whole constitute pressure introducing means 18, which selects the first cylinder chamber 5 or second cylinder chamber 6 that is higher in pressure and introduces the pressure in the selected chamber into the working chamber 17.

The reduced axial portion 15*f* of the locking-unlocking piston 15 is formed with a circumferential groove 15*d* to receive the locking member 8 therein when the piston 15 is moved toward the left of FIG. 1. The circumferential groove 15*d* has a taper surface 15*c* to bias the locking member 8 radially outwardly when the piston 15 is moved toward the right of FIG. 1. If the locking member 8 is moved into the circumferential groove 15*d*, then the main piston 4 is unlocked and free to move within the cylinder chamber 1*c*. The locking member 8 is provided with a concave, spherical hole 8*a* adapted to receive a ball detent 21 in the unlocked position of the locking member 8. The ball detent 21 is biased into its latching position by a spring 19. When the locking member 8 has been moved radially inwardly so as to be disengaged from the locking groove 9, the ball detent 21 enters the spherical hole 8*a* and holds the locking member 8 against involuntary movements and rattling.

A hollow cylindrical member 22 is received in the bore formed in the forward end cap 1*a* of the cylinder 1 and extends axially into the main piston 4 through the bore formed in the main piston 4. The cylindrical member 22 further extends through the bore formed in the locking-unlocking piston 15 so that an annular oil passageway 23 is formed between the outer peripheral surface of the cylindrical member 22 and the inner peripheral surface of the locking-unlocking piston 15, as shown in FIG. 1. The hollow cylindrical member 22 is sealed to the back end cap 1*b* and the main piston 4 by sealing rings 35 and 36. The oil passageway 23 communicates at its one end with the working chamber 17 through a radial orifice 24 formed in the locking-unlocking piston 15, and at the other end with a drainage port 26 formed in the back end cap 1*b* of the cylinder 1 through a communicating passageway 25 formed in the cylindrical member 22. If fluid pressure is introduced into the working chamber 17, then the fluid in the working chamber 17 is gradually drained from the cylinder 1 through the radial orifice 24, oil passageway 23, communicating passageway 25 and through the drainage port 26. The pressure $P_2$ in the working chamber 17 when the check valve 13 has been closed (pressure to which the working surface 15*b* of the locking-unlocking piston 15 is subjected) is given by the following equation:

$$P_2=\{A_1^2(P_1-P_3)\}/(A_1^2+A_2^2)$$

where $P_1$ is the pressure in the second cylinder chamber 6, $P_3$ is the pressure in the working chamber 11, $A_1$ is the area of the axial orifice 12, and $A_2$ is the area of the radial orifice 24. In this embodiment, the area $A_1$ of the axial orifice 12 is made greater than the area $A_2$ of the radial orifice 24 in order to secure the pressure $P_2$ by which the locking mechanism 7 is operated. The cylindrical member 22 is electrically connected by wires 27 to an exterior system and has coils (not shown) wounded therearound. The coils and an iron core 28 attached to the main piston 4 as a whole constitute a differential transformer 29 which is well known in the prior art and senses the displacement of the main piston 4.

The operation of the hydraulic actuator with the locking mechanism 7 will hereinafter be described.

Assume now that the main cylinder 4 has been locked by the locking member 8 held in the annular locking groove 9 of the cylinder 1, as shown in FIG. 1. If fluid under high pressure is supplied through the port 3 to the second cylinder chamber 6, the high pressure is introduced through the axial orifice 12 into the working chamber 17 and applied to the working surface 15*b* of the locking-unlocking piston 15. The locking-unlocking piston 15 is then moved axially outwardly against the bias of the spring 16. This causes the locking member 8 to move radially inwardly to its unlocking position. That is, the locking member 8 is disengaged from the annular locking groove 9 of the cylinder 1 to unlock the main cylinder 4, and therefore the main cylinder 4 is free to move. The ball detent 21 enters the spherical hole 8*a* and holds the locking member 8 to the main cylinder 4, so that an inaccurate locking operation is prevented. If the main piston 4 that has been subjected to the pressure of the second cylinder chamber 6 moves in an extending direction toward a predetermined position, the fluid in the first cylinder chamber 5 is then drained from the cylinder 1 through the retracting port 2. At the same time, the fluid that has been introduced from the second cylinder chamber 6 into the working chamber 17 and applied to the locking-unlocking piston 15 is drained little by little from the cylinder 1 through the radial orifice 24, oil passageway 23, connecting passageway 25 and through the drainage port 26.

If, on the other hand, fluid under high pressure is supplied through the retracting port 2 to the first cylinder chamber 5 with the main cylinder 4 held in its locking position by the locking mechanism 7, then the high pressure is introduced through the check valve 13 into the working chamber 17 and applied to the working surface 15*b* of the locking-unlocking piston 15. The locking-unlocking piston 15 is then moved axially outwardly against the bias of the spring 16. This causes the locking member 8 to move radially inwardly to its unlocking position. That is, the locking member 8 is disengaged from the annular locking groove 9 of the cylinder 1 to unlock the main cylinder 4, and therefore the main cylinder 4 is free to move.

Thereafter, if the high pressure that has been supplied in the first cylinder chamber 5 or second cylinder chamber 6 decreases, then the locking-unlocking piston 15 is moved toward the right of FIG. 1 by the bias of the spring 16, and the locking member 8 is biased radially outwardly by the taper surface 15*c* of the locking-unlocking piston 15. Therefore, when the main piston 4 is subjected to an external force and has reaches a predetermined position, the locking member 8 is moved into the annular locking groove 9 of the cylinder 1 and the main piston 4 thus locked to the cylinder 1.

Thus, in the above described embodiment of the invention, the higher pressure in the first chamber 5 or second chamber 6 in the cylinder 1 is introduced by the pressure introducing means 18 into the working chamber 17 of the main piston 4, and the locking-unlocking piston 15 is moved by the higher pressure. This movement causes the locking member 8 to move into its locking position. Therefore, since the pressure in the first chamber 5 or second chamber 6 used for operating the main piston is also used for unlocking and locking the main piston 4 and since the unlocking and locking parts inevitably employed in the conventional hydraulic actuator are not needed, the present invention can be made structurally simple, inexpensive and compact. In addition, since in the embodiment the main piston 4 is immediately unlocked even when either first chamber 5 or second chamber 6 becomes high pressure, the main piston 4 can be responded quickly to a control input even in the case that the main piston 4 is moved in any direction from the locked position. Therefore, if the hydraulic actuator of the present invention is used, for example, as a servo actuator for controlling flaps of aircraft, high responsibility will be secured. Consequently, the actuator according to the present invention is well suited to such a servo actuator, in cooperation with the differential transformer 29. In addition, since in this embodiment fluid can be passed little by little through the cylinder 1, main piston 4 and differential transformer 29, the temperature change of the hydraulic actuator can be effectively controlled, even if it is mounted in aircraft and the like and used under the condition of severe temperatures. Consequently, the reduction or breakage in material strength of each part caused by the heat deterioration can be prevented.

In the above described embodiment, the check valve 13 of the pressure introducing means 18 is provided adjacent to the cylinder chamber which supplies unlocking pressure to the locking-unlocking piston 15, in order to control the unlocking pressure. Therefore, the check valve 13 can be replaced with an orifice similar to the orifice 12. In that case, the pressures applied to the locking-unlocking piston 15 are different between when fluid under pressure is supplied to both the first chamber 5 and the second chamber 6 at the same time and when fluid under pressure is supplied to either the first chamber 5 or the second chamber 6. If, on the other hand, the orifice is replaced with a check valve similar to the check valve 13, fluid pressure above a predetermined pressure can be introduced into the working chamber 17 from the first chamber 5 or second chamber that is higher in pressure. Further, a plurality of orifices and check valves may be provided depending upon the pressure supplying conditions of the first and second chambers 5 and 6. While it has been described that, when the fluid pressure is introduced into the working chamber 17 by the pressure introducing means 18, the locking-unlocking piston 15 is moved to disengage the locking member 8 from the annular locking groove 9, it is noted that the locking-unlocking piston 15 may also be moved to temporarily engage the locking member 8 with the annular locking groove 9. That is, the main piston 4 is locked temporarily.

The invention has been described with reference to the preferred embodiment. Obviously modifications and alternations will occur to others upon a reading and understanding of this application. It is intended to include all such modifications and alternations insofar as they come within the scope of the appended claims or the equivalents thereof.

What is claimed is:

1. A hydraulic actuator comprising:

a cylinder formed with an axial cylinder chamber, a first port, and a second port;

a main piston provided in said cylinder chamber and dividing said chamber into a first chamber communicating with said first port and a second chamber communicating with said second port;

said main piston being formed with a locking chamber;

an annular locking groove formed in said cylinder;

a locking member cooperating with said annular locking groove to lock said main piston in an axially intermediate position between axially opposite ends of said cylinder;

said locking member being supported to said main piston so as to move radially inwardly into an unlocking position to unlock said main piston and radially outwardly into a locking position to lock said main piston;

a locking-unlocking piston for moving said locking member into aid locking and unlocking positions;

said locking-unlocking piston being provided in said locking chamber of said main piston;

pressure introducing means for selecting said first or second chamber that is higher in pressure and introducing the higher pressure in said selected chamber into said locking chamber of said main piston;

said pressure introducing means being formed in said main cylinder and comprising a passageway having first and second ends opening to said first and second chambers and a third end opening to said locking chamber of said main piston; and said locking-unlocking piston being moved by the pressure introduced by said pressure introducing means to move said locking member into said locking and unlocking positions.

2. A hydraulic actuator as set forth in claim 1, which further comprises spring-biased detent means for holding said locking member in its unlocking position.

3. A hydraulic actuator as set forth in claim 1, wherein said pressure introducing means further comprises an orifice and a check valve which are provided in said passageway.

4. A hydraulic actuator as set forth in claim 1, wherein said pressure introducing means further comprises a first orifice and a second orifice which are provided in said passageway.

5. A hydraulic actuator as set forth in claim 1, wherein said pressure introducing means further comprises a first check valve and a second check valve which are provided in said passageway.

6. A hydraulic actuator as set forth in claim 1, wherein said pressure introducing means further comprises a plurality of orifices and check valves which are provided in said passageway.

7. A hydraulic actuator as set forth in claim 1, wherein said locking-unlocking piston has a pressure receiving portion which is provided in said locking chamber by said main piston to which said third end of said passageway of said pressure introducing means opens.

8. A hydraulic actuator comprising:

a cylinder formed with an axial cylinder chamber, a first port, and a second port;

a main piston provided in said cylinder chamber and dividing said chamber into a first chamber communicating with said first port and a second chamber communicating with said second port;

said main piston being formed with a locking chamber;

an annular locking groove formed in said cylinder;

a locking member cooperating with said annular locking groove to lock said main piston in a predetermined position;

said locking member being supported to said main piston as to move radially inwardly into an unlocking position to unlock said main piston and radially outwardly onto a locking position to lock said main piston;

a locking-unlocking piston for moving said locking member into said locking and unlocking positions;

said locking-unlocking piston for moving said locking member into said locking and unlocking positions;

said locking-unlocking piston being provided in said locking chamber of said main piston;

an orifice formed in said locking-unlocking piston;

a hollow cylindrical member mounted in said cylinder and having said main piston slidably inserted thereon;

a passageway formed in said hollow cylindrical member;

pressure introducing means for selecting said first or second chamber that is higher in pressure and introducing the higher pressure in the selected chamber into said locking chamber of said main piston, said higher pressure introduced into said locking chamber by said pressure introducing means being drained through said orifice formed in said locking-unlocking piston and through said passageway formed in said hollow cylindrical member;

said pressure introducing means being formed in said main cylinder; and said locking-unlocking piston being moved by the pressure introduced by said pressure introducing means to move said locking member into said locking and unlocking positions.

9. A hydraulic actuator comprising:

a cylinder formed with an axial cylinder chamber, a first port, and a second port;

a main piston provided in said cylinder chamber and dividing said chamber into a first chamber communicating with said first port and a second chamber communicating with said second port;

said main piston being formed with a locking chamber;

an annular locking groove formed in said cylinder;

a locking member cooperating with said annular locking groove to lock said main piston in a predetermined position;

said locking member being supported to said main piston as to move radially inwardly into an unlocking position to unlock said main piston and radially outwardly onto a locking position to lock said main piston;

a locking-unlocking piston for moving said locking member into said locking and unlocking positions;

said locking-unlocking piston for moving said locking member into said locking and unlocking positions;

said locking-unlocking piston being provided in said locking chamber of said main piston;

an orifice formed in said locking-unlocking piston;

a hollow cylindrical member mounted in said cylinder and having said main piston slidably inserted thereon;

a passageway formed in said hollow cylindrical member;

pressure introducing means for selecting said first or second chamber that is higher in pressure and introducing the higher pressure in the selected chamber into said locking chamber of said main piston, said higher pressure introduced into said locking chamber by said pressure introducing means being drained through said orifice formed in said locking-unlocking piston and through said passageway formed in said hollow cylindrical member;

said pressure introducing means being formed in said main cylinder and comprising a passageway formed in said main piston and having ends opening to said first and second chambers and an end opening to said locking chamber of said main piston, and an orifice and a check valve which are provided in said passageway; and said locking-unlocking piston being moved by the pressure introduced by said pressure introducing means to move said locking member into said locking and unlocking positions.

10. A hydraulic actuator as set forth in claim 8, which further comprises displacement detecting means having coils mounted on said hollow cylindrical member and an iron core fixed to said main piston and inserted into said passageway of said hollow cylindrical member, for detecting a displacement of said main piston relative to said cylinder from the relative displacement between said core and said hollow cylindrical member.

11. A hydraulic actuator as set forth in claim 9, which further comprises displacement detecting means having coils mounted on said hollow cylindrical member and an iron core fixed to said main piston and inserted into said passageway of said hollow cylindrical member, for detecting a displacement of said main piston relative to said cylinder from the relative displacement between said core and said hollow cylindrical member.

* * * * *